United States Patent [19]

Sercombe

[11] 4,163,420

[45] Aug. 7, 1979

[54] COMPACTOR ARRANGEMENT

[75] Inventor: Geoffrey Sercombe, Ruislip, England

[73] Assignee: G. S. Compactors Limited, Middlesex, England

[21] Appl. No.: 807,518

[22] Filed: Jun. 17, 1977

[30] Foreign Application Priority Data

Jun. 23, 1976 [GB] United Kingdom ..... 26158/76

[51] Int. Cl.[2] ..... B30B 7/00

[52] U.S. Cl. ..... 100/223; 100/226; 100/233

[58] Field of Search ..... 100/221, 223, 226, 233; 53/124 B

[56] References Cited

U.S. PATENT DOCUMENTS

| | | | |
|---|---|---|---|
| 628,663 | 7/1899 | Hysore | 100/223 X |
| 1,483,013 | 2/1924 | Roberts | 100/226 X |
| 2,984,957 | 5/1961 | Lundgren | 100/221 X |
| 3,280,727 | 10/1966 | Jonas | 100/233 X |
| 3,357,346 | 12/1967 | Crafoord | 100/226 |
| 3,540,495 | 11/1970 | Lundgren | 100/223 X |

FOREIGN PATENT DOCUMENTS

| | | | |
|---|---|---|---|
| 2258924 | 6/1973 | Fed. Rep. of Germany | 100/233 |

*Primary Examiner*—Billy J. Wilhite

*Attorney, Agent, or Firm*—Fay & Sharpe

[57] ABSTRACT

A compactor arrangement is proposed for compacting waste in skips; that is to say, open-topped, truck-borne containers such as are used by builders and municipal authorities. The compactor arrangement includes a compactor having a pressure platen which can move generally upwardly and downwardly out of and into a skip, means for receiving and locating a plurality of skips, and means for effecting relative movement between the compactor and the receiving and locating means, whereby in use the pressure platen of the compactor can be caused to make successive compacting strokes on different skips in turn.

7 Claims, 8 Drawing Figures

COMPACTOR ARRANGEMENT

FIELD OF THE INVENTION

This invention relates to an arrangement for compacting material in large open top containers known as skips.

DISCUSSION OF PRIOR ART

A compactor is disclosed and claimed in my British Pat. No. 1,427,003. Devices for compacting domestic rubbish, e.g. rubbish in sacks, are disclosed in U.S. Pat. Nos. 3,357,346 and 3,413,913. A baler is disclosed in U.S. Pat. No. 3,280,727. None of these devices are practical for use at a civic amenity site. This invention is directed to a compactor arrangement suitable for installation and use at civic amenity sites. Such sites are often owned and operated by a local authority so that members of the public can bring to them their bulky refuse (such as may not be acceptable to the normal refuse collection services). The refuse is then placed in skips and the skips are then transported to a landfill site. This state of the operation is becoming expensive, particularly because the contents of a skip containing uncompacted refuse are largely air.

SUMMARY OF THE INVENTION

In accordance with one aspect of the present invention, we provide a compactor arrangement including a compactor having a pressure platen which can move generally upwardly and downwardly out of and into a skip, means for receiving and locating a plurality of skips, and means for effecting relative arcuate movement between the compactor and the receiving and locating means, whereby in use the pressure platen of the compactor can be caused to make successive compacting strokes on different skips, arcuately spaced from one another, in turn.

PREFERRED EMBODIMENTS

In one version of this invention, the compactor is constructed so that in use the pressure platen performs an arcuate movement relative to a skip, the portion of said movement within the skip being generally vertical. This design of compactor is the subject of British Pat. No. 1,427,003 to which the reader is referred for further details.

In another version of the invention, drive means for the platen are provided whereby the platen makes a vertical movement relative to a skip placed thereunder. Such a drive means may be constituted by an hydraulic ram mounted with its axis (line of applied force) vertical.

The compactor is disposed in relation to the receiving and locating means so that the relative movement is arcuate, for example, circular.

According to one embodiment of this invention, a skip compaction facility is provided according to which a plurality of skip receiving locations are provided based circularly around a central point, and a compactor device is mounted so that it can be rotated to any one of a plurality of positions, in each of which it can compact the contents of a skip placed in one of the locations.

In an alternative version of the invention, a turntable is provided having means for carrying thereon a plurality of skips, and a compactor device is provided at one radial location of the turntable. It will readily be realised that with such an arrangement a skip can be compacted, the turntable rotated, the next skip compacted, and so on, as desired. The skips may be run on or off the turntable, at a non-compacting station, by suitably positioned rollers. The turntable may carry three, or four, or five, or any other suitable number of skips, but four is the presently-prepared number.

DESCRIPTION OF THE DRAWINGS

The invention will be better understood from the accompanying drawings in which.

DETAILED DESCRIPTION OF PREFERRED EMBODIMENTS

Figure 1:
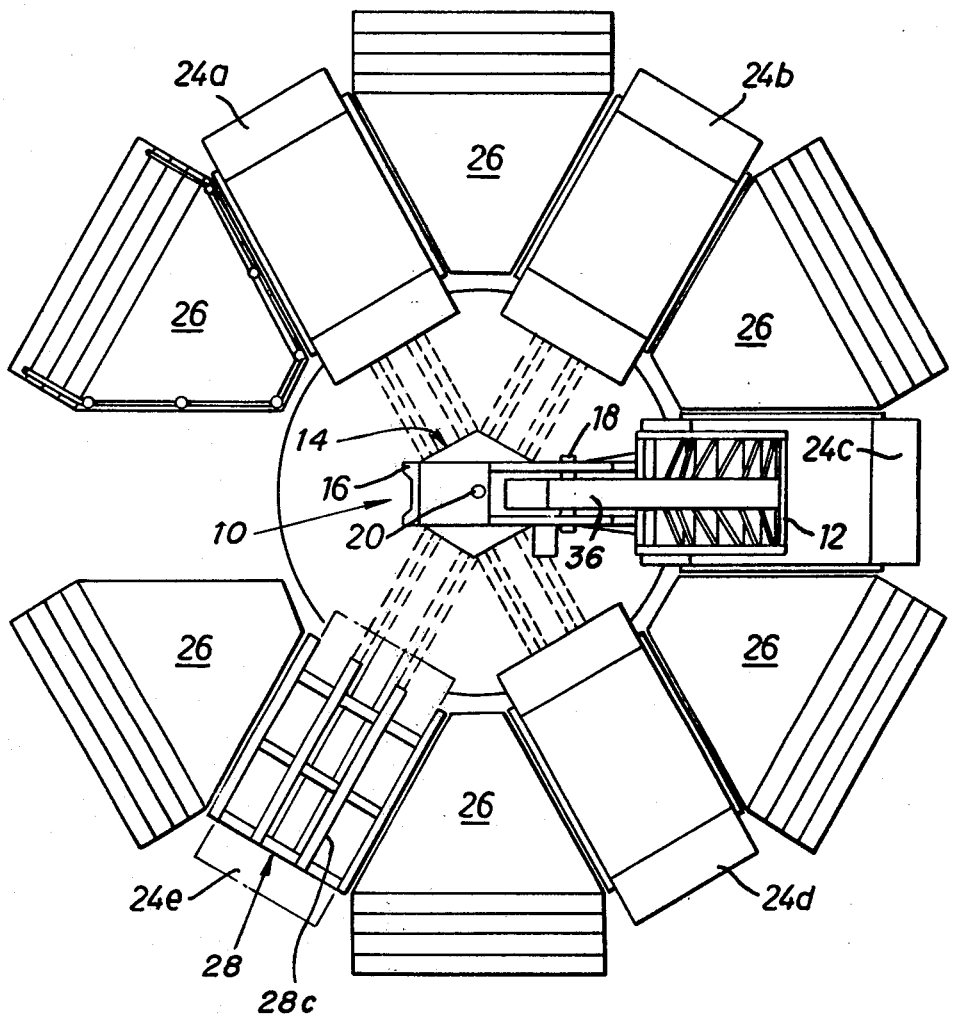
FIG. 1 is a plan view of one example of the invention.
Figure 2:
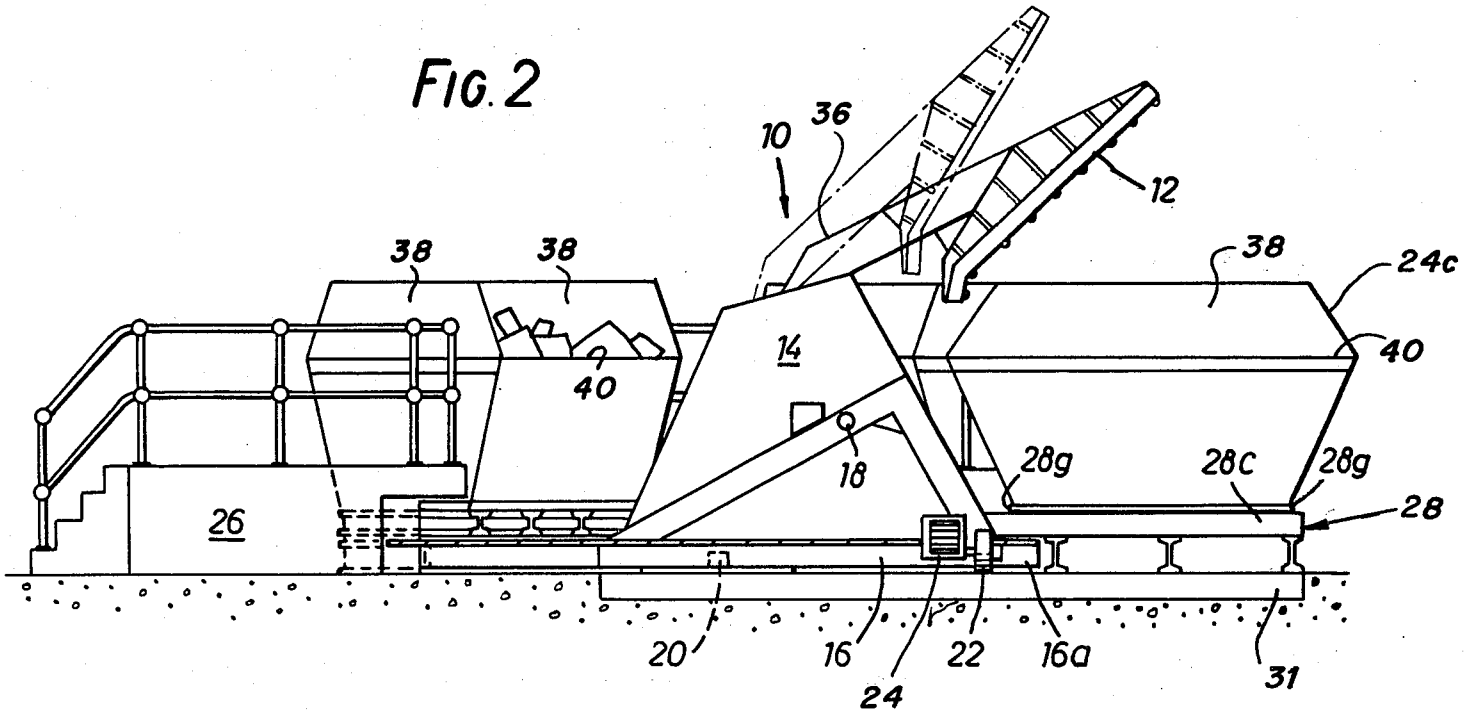
FIG. 2 is a side elevation of the arrangement shown in FIG. 1.

Referring to FIGS. 1 and 2, a compactor is illustrated at 10, having a pressure platen 12, a body 14, and a base 16. The platen is pivoted to the body by a horizontal pivot pin 18. As disclosed in the aforementioned British Pat. No. 1,427,003, the pressure platen may be reciprocated by any suitable means including an hydraulic ram, a motor driven screw device, a winch device, a motor driven gear train or by electromagnetic means. The base 16 is supported on the ground by a vertical pivot pin 20 and a wheel or roller 22. The roller 22 is arranged to be driven by a motor 24. The motor may be electrical or hydraulic, or of any other convenient form. It will be realised that when the roller 22 is driven the compactor describes a circular path around the pivot 20, and so can take up any positions seen in FIG. 1.

The arrangement includes receiving and locating means for skips, five such skips being illustrated at *24a–24e*. Such means are in part formed by a plurality of concrete plinths 26, which are built adjacent to a series of skip-supports 28, each of which is in turn supported by suitable beams or girders 31. The skips are also located by lugs (*28g*) on the skip support. It will be seen from FIG. 2 that the forward end *16a* of the compactor base 16 extends under a marginal part of a skip support *28c* when the compactor 10 is in its pivotal position appropriate for compacting the contents of the skip *24c*. This positioning of the forward end *16a* prevents the front end of the compactor 10 being lifted by the forces applied during compaction. That is, the downward pushing force applied by the platen 12 causes a reaction force on the platen base support 16 which tends to lift the base support forward end *16a*. This reaction force also tends to deform the pivot mounting 20 shown in FIGS. 1 and 2, the pivot mounting 30 shown in FIG. 5, or the pivot 120 in FIG. 8. The marginal part of the skip guide and support means beneath which the forward end *16a* is received cooperates therewith to define cooperating means for preventing the platen base support and its forward end from being lifted by forces applied during compaction of material in a skip by the platen 12.

It will readily be seen that the compactor 10 can compress the contents of the five skips in turn, and that while, for example the contents of skip 24*a* are being compacted, skip 24*e* which has been compacted could be removed by a known skip-transporter lorry and replaced by an empty skip.

Figure 3:
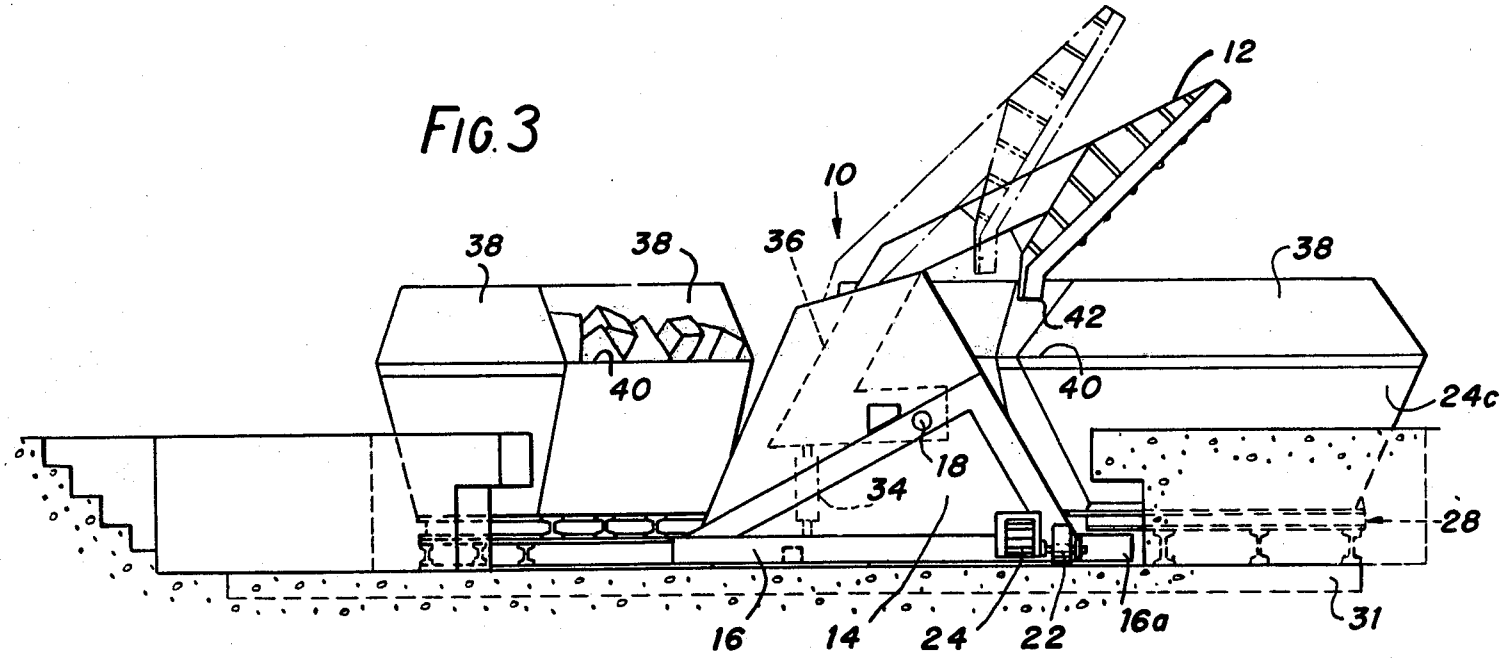
FIG. 3 is a side elevation of an alternative embodiment of the invention.

FIG. 3 shows one platen drive means of the type disclosed in the aforementioned British Pat. No. 1,427,003 as including an hydraulic cylinder 34 connected between arm 36 of platen 12 and base support 16. Selective operation of the cylinder 34 swings the platen arm 36 about the platen mounting means defined by the pivot pin 18 for moving the platen 12 between a raised position clear of a skip and a lowered compacting position within a skip. As clearly shown by the visible trash in the skip at the left side of FIGS. 2 and 3, each skip has side extensions 38 which project above the upper edge 40 of each skip. Thus, the bottom edge 42 of the platen 12 is only required to clear the upper skip edge 40 because the side extensions 38 are only along the skip sides.

The example of the invention shown in FIG. 3 is similar to that in FIGS. 1 and 2 except that the compactor and the skip supports are sunk in pits or recesses so that the skips can be filled (e.g. by the general public who will bring the refuse to such a site) without the people who fill them having to ascend steps up to a plinth.

Figure 4:
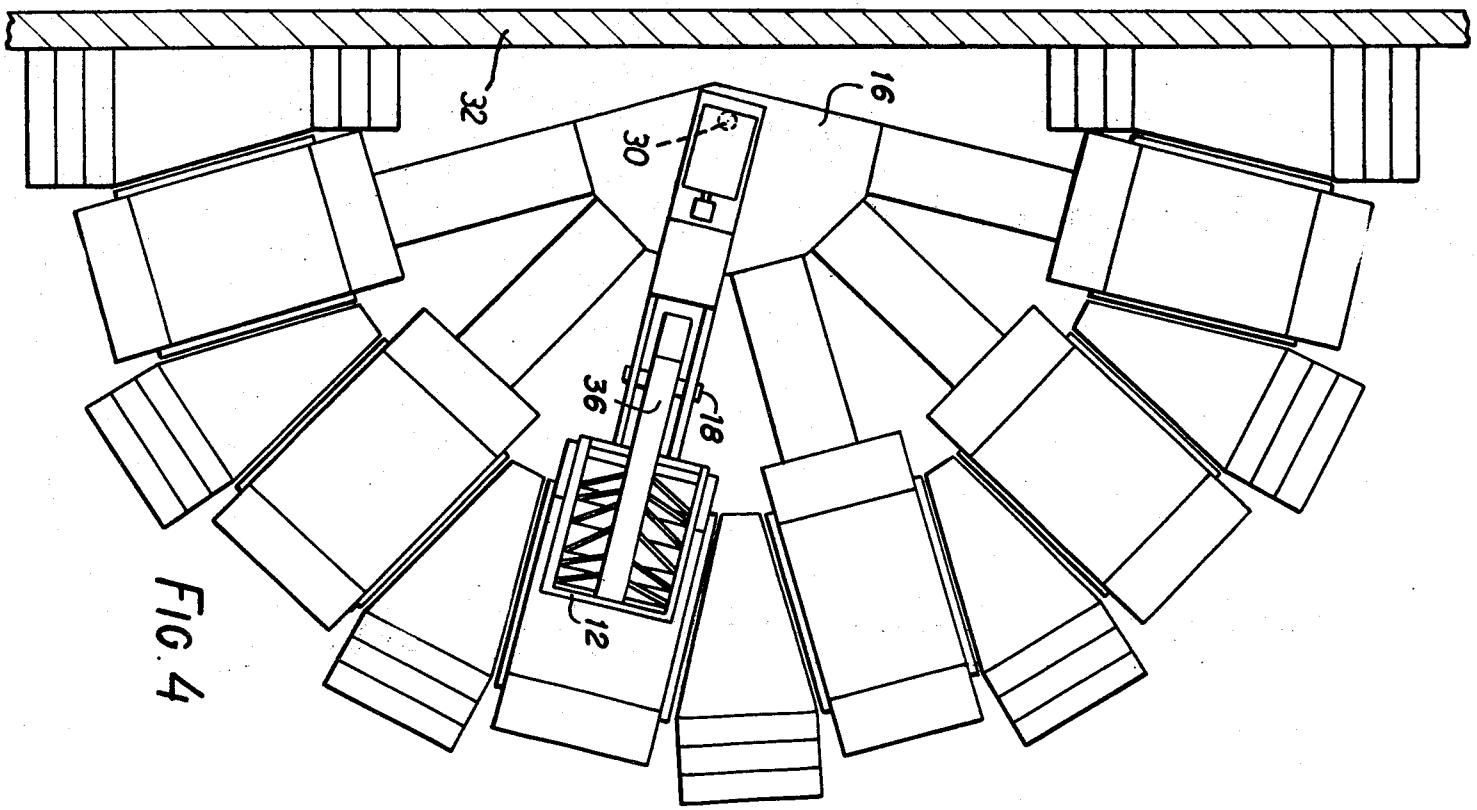
FIG. 4 is a plan view of a third embodiment of the invention.
Figure 5:
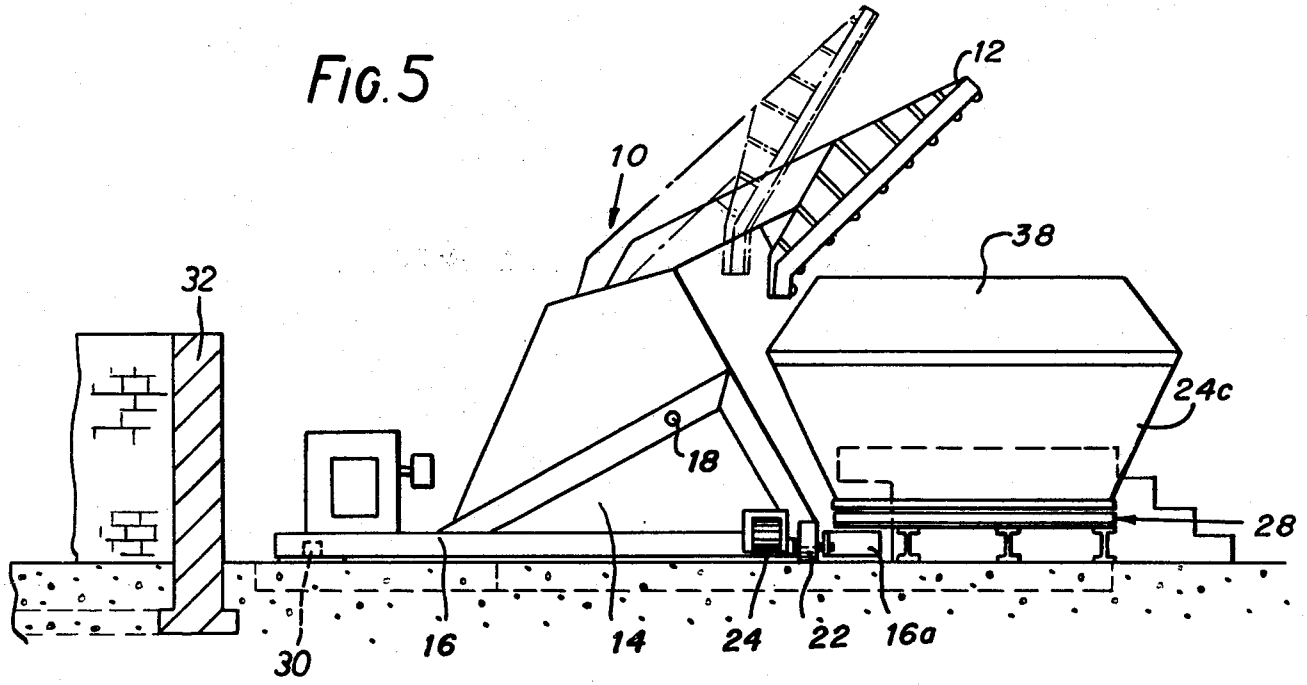
FIG. 5 is a side elevation of the arrangement shown in FIG. 4.

The example of the invention shown in FIGS. 4 and 5 is of an arrangement having receiving and locating means for six skips, and a compactor movable about a vertical pivot pin 30. The advantage of the FIG. 4 arrangement is that it can be located near a boundary wall 32 and is economical of space. In other respects it resembles the arrangement of FIGS. 1 and 2.

Figure 6:
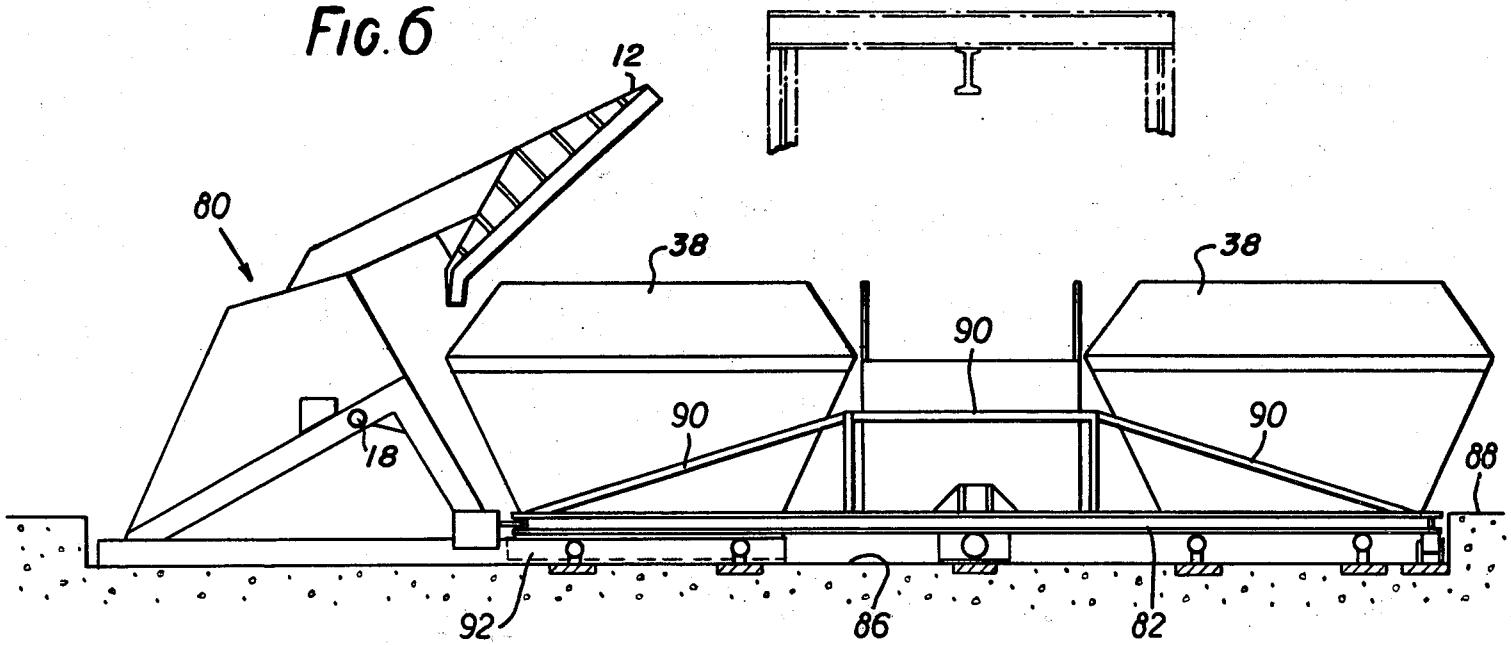
FIGS. 6 and 7 are respectively side elevation and plan views of a fourth embodiment of the invention.
Figure 7:
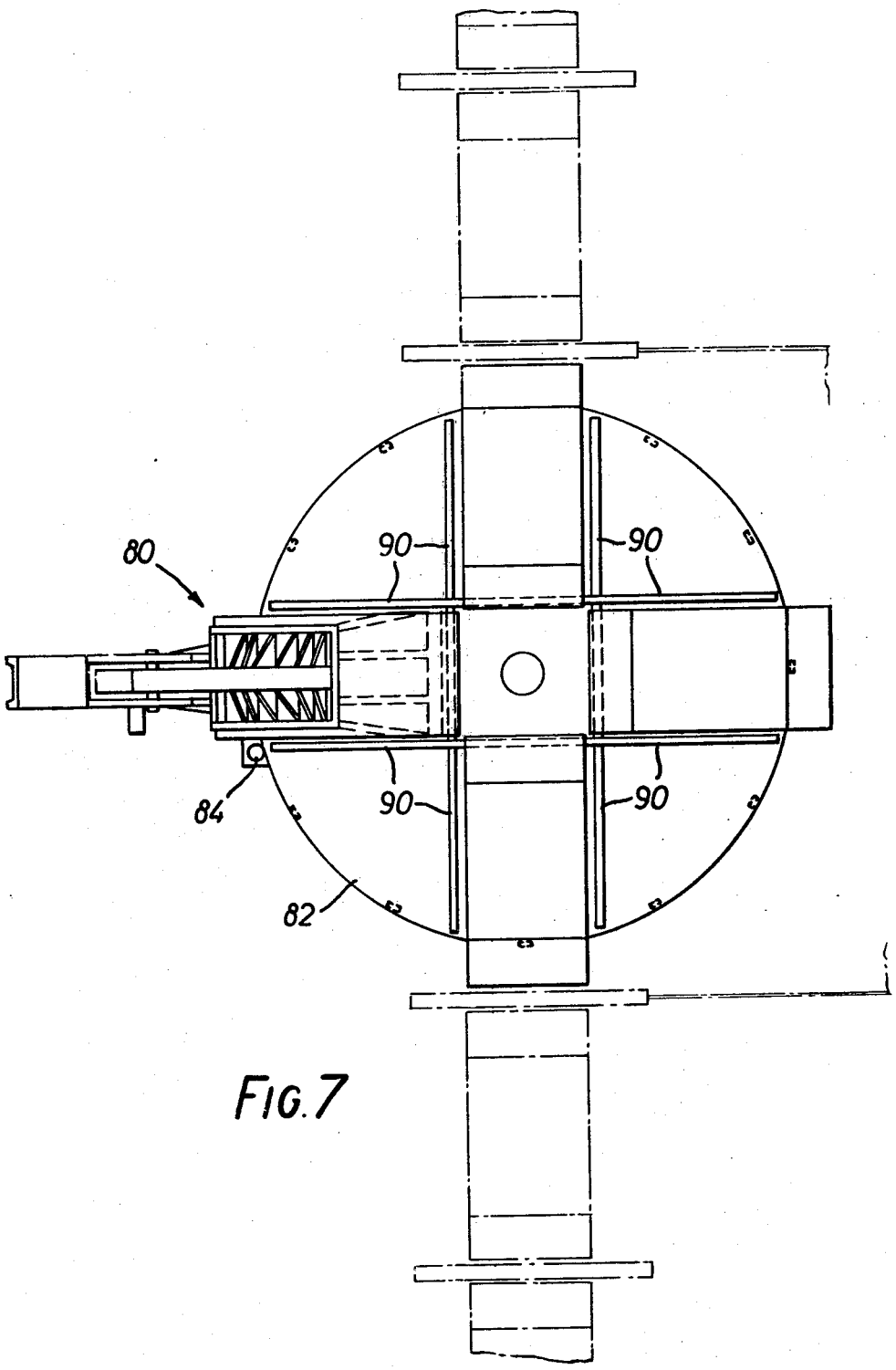

FIGS. 6 and 7 illustrate an example of the invention in which the skip receiving and locating means is a turntable 82 rotatable about a vertical axis in relation to a stationary compactor 80. The turntable has a friction or other type of drive 84, and, as illustrated in FIG. 6, is mounted in a pit 86 with its flat upper surface substantially co-planar with ground level 88. Railings 90 on the turntable define four skip-receiving locations. An extensible support 92 is provided to reduce the stress on the turntable during the application of compaction pressure.

In the various arrangements illustrated, a gantry with lifting means thereon may be provided for lifting and transporting the skips, and it will be understood that provision may be made for the public to tip extra refuse into skips that have already been compacted. In this way the extra skip volume made available can be fully utilized.

The word "ram" is used in this specification to mean any piston-cylinder or other linear powered actuator. While in this specification, reference has been made to the design of compactor the subject of British Pat. No. 1,427,003, it will be appreciated that other compactors can readily be used in arrangements according to this invention.

Figure 8:
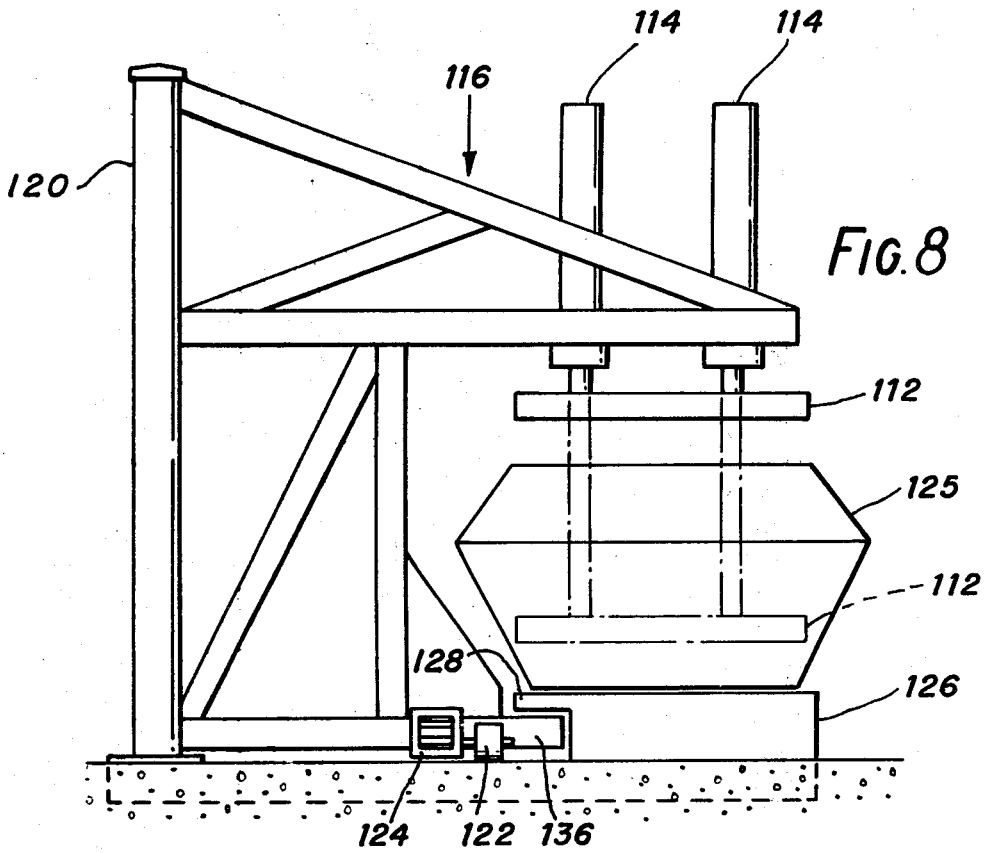
FIG. 8 illustrates a fifth embodiment of the invention having a vertically reciprocable platen carried by a ram or rams.

FIG. 8 illustrates a further embodiment of the invention, including a vertically reciprocable platen 112, carried by one or more rams 114, two being shown. In use, the platen assembly 116 is supported on wheel 122 driven by motor 124 and rotated around a vertical support post 120 for compacting refuse in a plurality of skips 125 arcuately spaced from one another about the post 120 on support 126. A projection 128 on the support 126 extends over the outer end of the lower support beam 136 on the platen assembly 116.

Reverting now to FIGS. 1 and 2, an important feature of this embodiment of the invention is the fact that the skip supports 28 and the pivot 20 are in effect an integral part due to the use of the beams or girders 30. This allows one to eliminate stress on the concrete foundations. Very substantial foundations would otherwise be required to stop the skip support platforms 28 being torn out of the ground at the end near the compactor 10. It can be seen that if the girders 30 were not provided then one would require a large mass of concrete (e.g. 30 tons weight) holding down the support 28 to provide adequate reaction to the upward forces exerted by 16*a* when peak compaction force is exerted by the platen 12.

I claim:

1. A compactor arrangement comprising: a platen support, a pressure platen mounted on said platen support for lowering and raising movement into and out of a skip, a skip support for supporting a plurality of skips and locating the skips for reception of said platen, one of said supports being movable relative to the other said support for aligning each skip with said pressure platen to compact material in each skip, platen drive means for moving said platen in compacting strokes for compacting material in each skip which is aligned with said platen, said supports being separate and being mounted independently of one another, and cooperating means between said supports for preventing said platen support from being lifted due to forces applied during compaction of material in a skip by said platen.

2. The compactor arrangement of claim 1 wherein said cooperating means includes a marginal part on said skip support and a projecting part on said platen support received beneath said marginal part.

3. The compactor arrangement of claim 1 wherein said platen support is movable relative to said skip support for selectively aligning said platen with each skip on said skip support.

4. The compactor arrangement of claim 3 wherein said cooperating means includes a marginal part on said skip support and a projecting part on said platen support received beneath said marginal part.

5. The compactor arrangement of claim 1 wherein said skip support is movable relative to said platen support for selectively aligning said platen with each skip on said skip support.

6. The compactor arrangement of claim 1 wherein said platen support and skip support are positioned on the ground adjacent one another, said cooperating means including a marginal part on said skip support beneath which a forward end on said platen support is received.

7. The compactor arrangement of claim 1 wherein said one movable support is movable in an arcuate path.

* * * * *